United States Patent [19]

Virving

[11] 4,073,442

[45] Feb. 14, 1978

[54] ELECTRICALLY CONTROLLED SYSTEM FOR REGULATING THE GRINDING SPACE IN A GRINDING APPARATUS

[75] Inventor: Nils G. Virving, Vallingby, Sweden

[73] Assignee: Defibrator Aktiebolag, Stockholm, Sweden

[21] Appl. No.: 786,115

[22] Filed: Apr. 8, 1977

Related U.S. Application Data

[63] Continuation of Ser. No. 670,359, March 25, 1976, abandoned.

[30] Foreign Application Priority Data

Apr. 7, 1975 Sweden ..... 7503967

[51] Int. Cl.[2] ..... B02C 7/14

[52] U.S. Cl. ..... 241/37; 241/259.2

[58] Field of Search ..... 241/30, 33, 37, 259.2

[56] References Cited

U.S. PATENT DOCUMENTS 3,212,721 10/1965 Asplund et al. ..... 241/37

*Primary Examiner*—Granville Y. Custer, Jr.

*Attorney, Agent, or Firm*—Eric Y. Munson

[57] ABSTRACT

A system for measuring and regulating the grinding space between two metallic grinding discs and to prevent direct contact therebetween; one of the discs being rotated while the other one remains stationary to grind therebetween fibrous cellulosic material, such as moisture-containing wood chips, for pulp making. One of the discs is electrically insulated from the other parts of the system and is included in an electric circuit with the positive and negative terminals connected to the disc at points electrically insulated from one another and the moisture in the wood chips collected in the grinding space is used to produce a conductive cell, such as an electrolytic variable resistance, which bridges the two terminals and closes the circuit. The resistance of the cell which varies in response to fluctuations in the grinding space is measured by an ammeter or similar measuring device which thus gives a reading of the width of the grinding space. The measuring device may be used to actuate means for regulating the width of the grinding space and to stop the grinding operation immediately upon contact between the grinding discs.

7 Claims, 3 Drawing Figures

ELECTRICALLY CONTROLLED SYSTEM FOR REGULATING THE GRINDING SPACE IN A GRINDING APPARATUS

This is a continuation, of application Ser. No. 670,359 Filed Mar. 25, 1976, now abandoned.

FIELD OF THE INVENTION

This invention relates to a grinding apparatus for desintegration of material in the interspace between two grinding members mounted rotatably in relation to one another.

More particularly this invention relates to a device for preventing metallic contact and for measuring and controlling the spacing between said grinding members.

Still more particularly this invention relates to a device for measuring and controlling by means of an electric circuit the spacing between two electrically conductive grinding members in a grinding apparatus of the type in which at least one of the members is rotated by a rotatable shaft and through motor means, such as a servomotor, exerts axial pressure on the material to be ground while it passes through the interspace between the grinding members, and in which at least one element associated with one of the grinding members is electrically insulated from all other parts of the grinding apparatus.

THE PRIOR ART

In known devices of the kind in consideration the electrically insulated element associated with one of the grinding members is a grinding segment of a disc-shaped contour.

The spacing between the grinding discs in a grinding apparatus, e.g. a refiner, must sometimes be adjusted in response to changes in capacities, concentrations and loads in such a manner that a desired high quality is obtained in the grinding produce. However, it has developed that the operating personnel do not always manage to perform these adjustments rapidly enough. This can result in the opposing grinding discs or its segments coming into metallic contact due to stretching in the base frame and shafts caused by compressions, stresses, tensions and/or variations in temperature. This face-to-face contact between the discs or segments subjects them to wear, and in serious cases may cause total break-down in operation.

MAIN OBJECTS OF THE INVENTION

One main object of the invention is to provide a device which which will eliminate such a metallic contact.

Another object of the invention is to provide a highly sensitive device to measure rapidly the spacing between two grinding members so that the grinding space can be adjusted in a simple manner.

A further object of the invention is to provide an automatic adjustment of the spacing between the grinding members.

SUMMARY OF THE INVENTION

The new device is characterized mainly by an electric circuit which includes a voltage source which has one terminal connected to an electrically insulated element associated with one of the grinding members and the other terminal connected to another portion of the same grinding member, so that the circuit will be closed by the gap between the terminals being bridged either by direct contact between the two grinding members or by a conductive cell in the interspace between the two grinding members which bridges the gap between the mutually insulated elements to generate in, the circuit a current which indicates the spacing between the grinding members.

It has proved that by this arrangement, the distance to be measured i.e. the flow distance of the current is doubled compared with the distance to be measured in known devices of this type. This means that the sensitivity of the circuit to changes in the width of the interspace between the grinding members is increased considerably. The doubling of the measured distance is largely due to the fact that the circuit current, because of the insignificant width of the interspace, even with the relatively thin insulation between the terminals, flows from the insulated element associated with one of the grinding members to the opposite grinding member and then to the other insulated element of the first-mentioned grinding member. Furthermore, when utilizing the new device, both terminals of the voltage source can be connected to a stationary grinding member, and thus, brushes, slip rings and other trouble-causing accessories may be eliminated.

DESCRIPTION OF A PREFERRED EMBODIMENT

Figure 1:
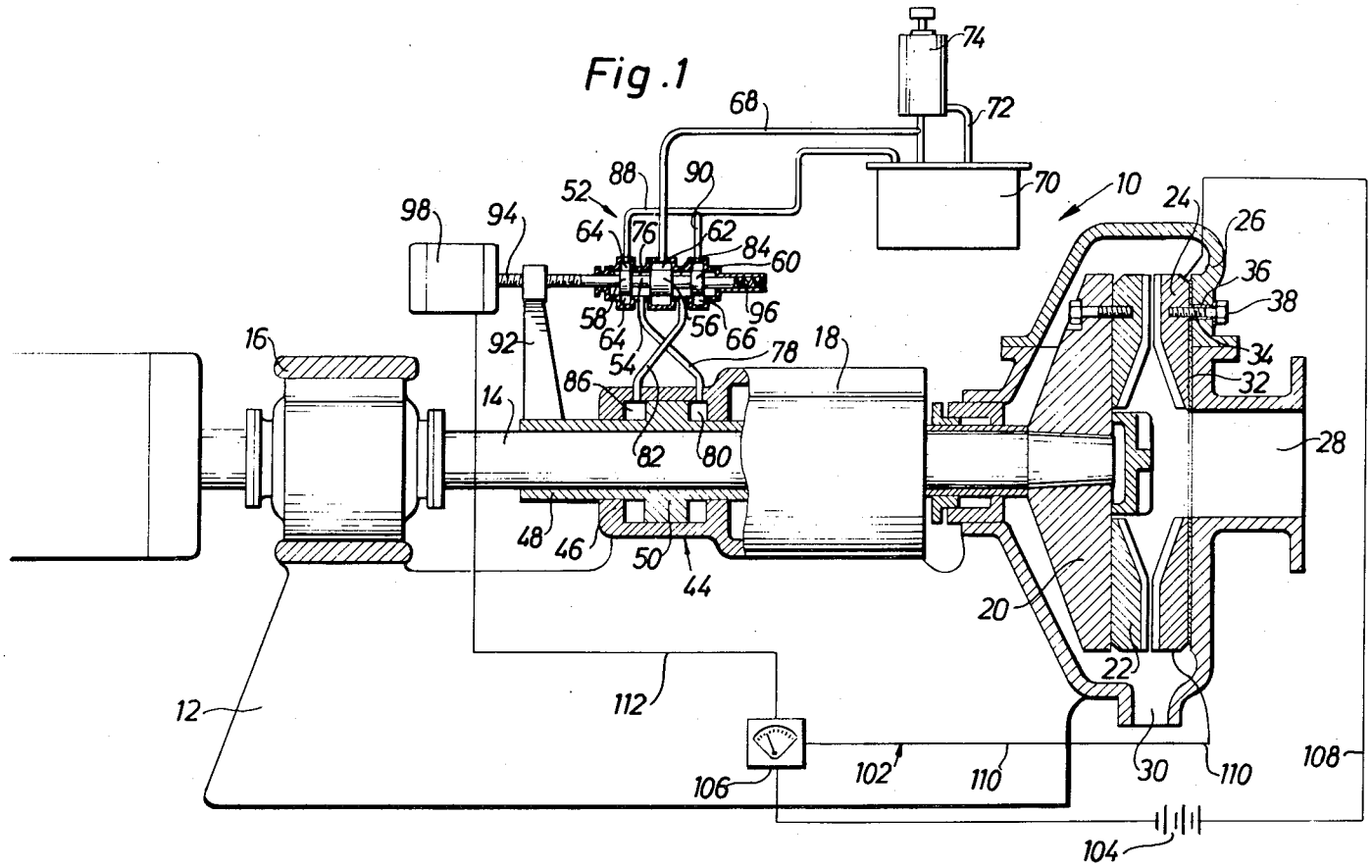
FIG. 1 is a vertical longitudinal sectional view of a conventional disc refiner equipped with a device constructed according to the principles of the invention.

In the drawings the novel device is shown in combination with a grindng apparatus in the nature of a refiner 10 for treating fibrous material, such as wood chips or wood shavings. However, it will be obvious to everybody skilled in the art that the invention can be applied to many similar fields of use.

Mounted in the base frame 12 of the apparatus 10 is a shaft 14 supported in two bearing housings 16 and 18. Said bearing housings 16, 18 are arranged so that the shaft 14 is displaceable in axial direction. In this connection reference is made to the U.S. Patent Specification No. 3,212,721 for further details in addition to those disclosed herein and illustrated in the drawings. The shaft 14 carries a rotor 20 provided with a grinding disc 22. Both the rotor 20 and the grinding disc 22 are rotatable together with the shaft 14. A stationary grinding disc 24 is by means of bolt connections 34 rigidly secured to a casing 26 which is split horizontally above the shaft 14. Material to be ground is supplied to the apparatus 10 through a central channel 28 in the casing 26 and is fed into the interspace between the grinding discs 22, 24 where it is disintegrated. Provided in the base portion of the casing 26 is a discharge opening 30 for removal of the ground material.

In the shown embodiment, the stationary grinding disc 24, which is fixed to the casing 26 by means of said bolt connections, is insulated electrically from the casing 26. By way of example, insulation may consist of an insulating plate 32 inserted between the rear side of the stationary grinding disc 24 and the casing 26. The plate 32 consists of some suitable insulating material which is not critical to the invention. For example, it has proved expedient to employ for this purpose a packing or gasket of plastic material of appropriate thickness. The bolts 34 which are used for fixing the stationary grinding disc 24 to the casing 26 are provided in the shown embodiment with insulation 36 of plastic material interposed between said bolts 34 and the casing 26. The insulation 36 extends also radially below the bolt heads 38. By an arrangement of this kind, the entire stationary grinding disc 24 is insulated electrically from all other parts of the grinding apparatus 10. However, this is not absolutely necessary for realizing the basic objective of the invention. According to the invention, one portion only of one of the grinding members has to be insulated electrically from the remainder of the grinding apparatus. In the embodiment illustrated in the drawings this portion consists of a disc segment 40 of conventional construction formed with ridges and intervening grooves and provided along its radial short sides and along the inner edge facing the shaft 14 with an electrically insulating layer 42 of the same kind as the insulating plate 32. For elucidation it may be mentioned that a grinding disc 24 of the kind in question usually is composed of twelve grinding disc segments. In order to obtain the required complete insulation of the grinding disc segment 40, it would be sufficient to replace the insulating plate 32 shown in the drawings by an insulating plate member which occupies a space only between the grinding disc segment 40 in question and the casing 26.

Mounted around the shaft 14 of the apparatus 10 is a hydraulic servomotor 44. The servomotor 44 comprises a casing or cylinder 46 which may be made integral with the bearing casing 18, and a piston 48 which concentrically and loosely surrounds the shaft 14. The piston 48 has a central flange 50 which is axially movable within the cylinder 46.

Rigidly secured to the cylinder 46 of the servomotor 44 is a pilot valve 52. Disposed in said pilot valve 52 is a piston 54 which is formed with a central flange 56 and two lateral flanges 58 and 60. The pilot valve 52 is further formed with a central chamber 62 and two side chambers 64 and 66 which are laterally defined by recesses 76, 84 having an inner diameter which corresponds to the outer diameter of the flanges 56, 58, 60. The flange 56 has an axial length which is shorter than the longitudinal extension of the chamber 62 by a very small fraction such as one hundredth or a few hundredths of a millimeter. In the same manner the flanges 58, 60 have an axial length which is only insignificantly less than that of the associated chambers 64 and 66, respectively. In their neutral position, all of the flanges 56, 58, 60 are aligned with their associated chambers 62, 64, 66, respectively.

A pipe 68 connects the central chamber 62 in the pilot valve 52 with an oil sump 70 in which a pump (not shown) is housed. A return pipe 72 connected to said pipe 68 is also connected to the sump 70 through a spring-loaded valve 74. From the recess 76 of the pilot valve 52 where its diameter reduced to that of the flanges extends a pipe 78 to a chamber 80 on one side of the flange 50 of the servomotor 44. A pipe 82 connects the recess 84 of the pilot valve 52 with a chamber 86 located on the opposite side of the flange 50. The lateral chambers 64, 66 are also connected to the sump 70 through return pipes 88 and 90, respectively.

A set screw 94 which is coaxial with the piston 54 of the pilot valve 52 is screwed into an arm 92 which is rigidly secured to servomotor piston 48 and which set screw adapted to abut against the projecting end of the piston. The other end of the piston 54 is subjected to pressure from a spring 96 in such a manner as to urge the valve piston 54 towards the set screw 94.

The setting of the set screw 94 is adjustable by means of a reversible electric motor 98, the shaft of which may either exert direct driving force on the set screw 94 or is formed integrally with the latter.

From the sump 70, oil of constant pressure is supplied through the pipe 68 to the central chamber 62 of the pilot valve 52. The piston 54 of the pilot valve 52 is kept by said spring action continuously forced against the set screw 94 and follows the axial movements of the same. If now the pressure between the grinding discs 22, 24 should be increased by accumulation of raw material in the grinding interspace and consequently the rotating grinding disc 22 together with the servomotor piston 48 displaced to the left, the set screw 94 will be forced to follow, since it is adjusted to a fixed position in the arm 92 which is to the piston 48. The pilot valve piston 54 follows the movement of the set screw 94 with the result that the oil pressure increases in the space 84 of the pilot valve 52 and, consequently, in the servomotor chamber 86 while the oil pressure in the servomotor chamber 80 is reduced correspondingly. Accordingly, increased pressure acting on the servomotor piston 54 is built up in order to restore the the interspace between the grinding discs 22, 24 to the original width. Normally, this interspace amounts to a few tenths of a millimeter only. Conversely, if the grinding discs 22, 24 due to insufficient feed of raw material should tend to come nearer to one another, the servomotor piston 48 and the set screw 94 follow accordingly and the pilot valve 52 will be displaced towards the right. Thus, an increase of pressure in the space 76 of the pilot valve 52 and in the servomotor chamber 80 will be increased while pressure in the space 84 and the servomotor chamber 86 will be decreased. Due to the fact that the difference in axial dimension between the flanges 56, 58, 60 of the pilot valve piston 54 and the surrounding chambers 62, 64, 66 is very small, the piston 54 has to perform only extremely small displacements in order to effect a change in the grinding pressure.

By changing the position of the set screw 94 relative to the arm 92, the pre-set interspace clearance between the grinding discs 22, 24 can be increased or reduced. This might have to be done in order to eliminate metallic contact between the discs 22, 24 due to stretching of the base frame and/or of the shaft.

Figure 2:
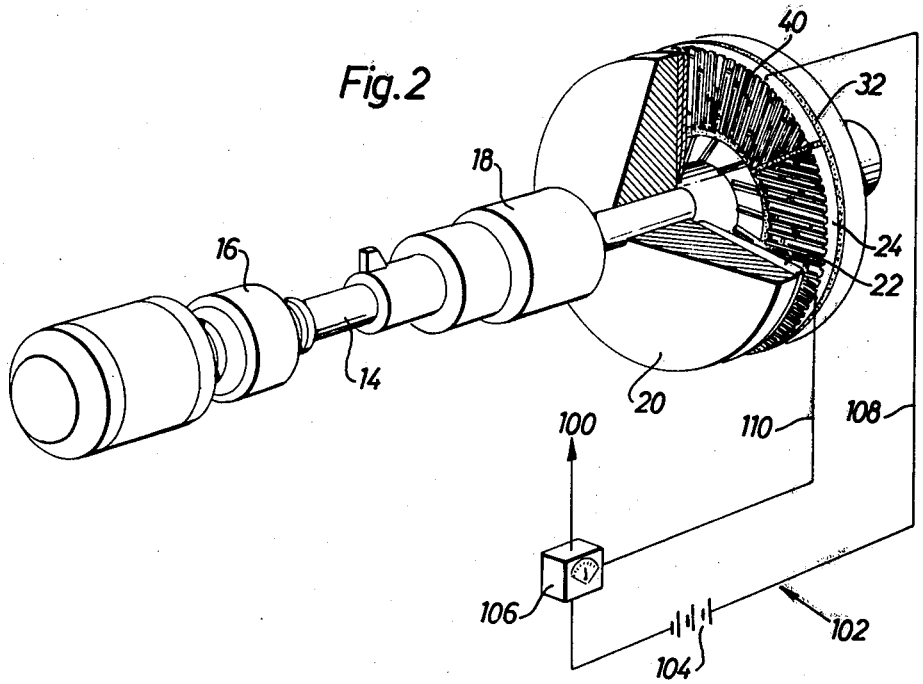
FIG. 2 is a perspective view of the novel device together with parts of the refiner illustrated in FIG. 1. To improve clarity some refiner portions are cut away.
Figure 3:
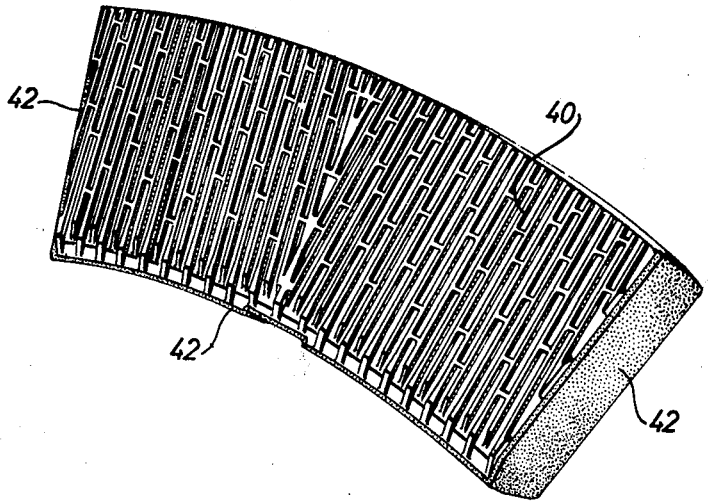
FIG. 3 shows an electrically insulated portion of a grinding member.

By combining the device according with the invention to the known grinding apparatus it has become possible to measure the spacing between the two grinding discs 22, 24 very accurately. The coupling of the measuring device intended for this purpose will be understood best from FIG. 2. In this figure an arrow 100 indicates that the measuring device can be connected to other equipment which are controlled by the the measuring system. The device consists essentially of an electric circuit 102, which in series comprises a DC-source 104, a measuring instrument 106 which indicates the spacing between the grinding discs 22, 24, the insulated grinding disc segment 40, the double interspace and the remainder of the grinding disc 24. Two separate branches 108, 110 of the circuit 102 are directly connected to the portions of the stationary grinding disc 24 which are electrically insulated from one another. It is now possible to read directly on the measuring instrument coupled into the measuring circuit 102, which instrument suitably consist of an ammeter, the spacing between the grinding discs 22, 24, since water usually is present in the (not shown) material to be ground located between said grinding discs. Water is a poor electric conductor. Therefore, extremely small fluctuations in the spacing will produce an amplified reading on the measuring instrument 106.

The electric motor 98 which drives the set screw 94 is connected electrically through a conductor 112 to the measuring instrument 106 in such a manner that the reading or deflections on the measuring instrument 106 is usable for controlling the electric motor 98. With an arrangement of this kind it is thus possible to obtain automatic adjustment of the spacing between the grinding discs 22, 24 to compensate for stretching and other distortion of the base frames and shafts as well as of parts associated therewith.

In addition to indicating the spacing between the grinding discs 22, 24, the invention also provides an automatic safety device which prevents damage to the grinding members and stoppage of the grinding operation due to metallic contact between the grinding discs 22, 24. It will be understood from the above description that the circuit 102 is closed immediately upon direct metallic contact between the discs, in which event, the electric motor 98 is controlled by the measuring instrument 106 or some other suitable means, such as circuit breaker or the like, coupled into the circuit, so that the grinding discs 22, 24 immediately are separated from one another.

POSSIBLE MODIFICATIONS

Although the invention has been described above as useful for avoiding contact, or measuring the spacing, between the grinding discs in a refiner it is obvious that the new device, as has already been indicated herein, is applicable also to other types of grinding apparatus, where the spacing between two grinding members rotatable relatively to one another is to be measured or metallic contact between such grinding members be prevented. The portion insulated electrically from the remainder of the grinding apparatus may of course comprise two or more grinding disc segments.

The portion of the one grinding member which is electrically insulated from all other parts of the grinding apparatus may consist of a separated current conductor which extends through the grinding member to the grinding surface thereof.

While one more or less specific embodiment of the invention has been shown and described, it is to be understood that this is for purpose of illustration only, and that the invention is not to be limited thereby but its scope is to be determined by the appended claims.

What is claimed is:

1. A system for measuring and regulating the interspace between a pair of relatively rotating metallic grinding discs in grinding apparatus for grinding fibrous cellulosic material, comprising:

(a) an electric circuit having its terminals connected to one of said grinding discs at portions electrically insulated from one another;

(b) conductive cell in said interspace bridging the terminals and having a resistance which varies in accordance with variations in the width of the interspace to thereby produce a fluctuating current; and (c) means in said circuit responsive to said current for measuring the width of said interspace.

2. A system according to claim 1, in which the fibrous cellulosic material comprises moisture-containing wood chips and the conductive cell comprises moisture resulting from the grinding process.

3. A system according to claim 1, in which the grinding discs comprise at least two segments electrically insulated from one another and the terminals are connected to separate segments.

4. A system according to claim 1, in which one of the grinding discs is stationary while the other one rotates, and the circuit is connected to the stationary disc.

5. A system according to claim 1, in which the interspace measuring means comprise an ammeter in which the current deflection indicator is calibrated to measure the width of the interspace.

6. A system according to claim 4, in which the rotating disc is supported on a shaft which is reciprocated axially by servomotor means actuated by said interspace measuring means in response to current fluctuations to maintain said interspace at a predetermined width.

7. A system according to claim 6, in which the electric circuit includes circuit-breaking means for interrupting grinding operations upon metallic contact between the discs.

* * * * *